US007444695B2

(12) United States Patent
Gonzalez

(10) Patent No.: US 7,444,695 B2
(45) Date of Patent: Nov. 4, 2008

(54) INFANT/TODDLER CARRYING APPARATUS

(76) Inventor: Rebekah Gonzalez, 210 Combe Dr., Winchester, VA (US) 22602

( * ) Notice: Subject to any disclaimer, the term of this patent is extended or adjusted under 35 U.S.C. 154(b) by 0 days.

(21) Appl. No.: 11/641,676

(22) Filed: Dec. 20, 2006

(65) Prior Publication Data

US 2008/0148482 A1 Jun. 26, 2008

(51) Int. Cl.
*A47G 9/02* (2006.01)
*A41B 13/06* (2006.01)

(52) U.S. Cl. ..... 5/494; 5/482; 5/485; 5/655; 2/69.5

(58) Field of Classification Search ..... 5/494, 5/482, 485, 655, 413 R, 628; 2/69, 69.5; 297/219.12, 256.17
See application file for complete search history.

(56) References Cited

U.S. PATENT DOCUMENTS 787,848 A * 4/1905 Lung ..... 5/628
919,159 A * 4/1909 Goddard ..... 5/628
1,538,538 A * 5/1925 Wood ..... 297/229
2,410,181 A * 10/1946 Peters ..... 5/628
2,489,828 A * 11/1949 Springer ..... 5/628
2,899,692 A * 8/1959 Finken ..... 5/628
3,578,380 A * 5/1971 Jacobus ..... 297/229
3,601,824 A * 8/1971 Bradford ..... 5/628
3,962,738 A * 6/1976 Menditto ..... 5/494
3,986,505 A * 10/1976 Power ..... 128/846
4,124,908 A * 11/1978 Burns et al. ..... 5/628
4,597,121 A * 7/1986 Bouma ..... 5/494
4,601,075 A * 7/1986 Smith ..... 5/628
4,611,353 A * 9/1986 Als et al. ..... 2/69
4,970,739 A * 11/1990 Bradford ..... 5/625
4,979,520 A * 12/1990 Boone, Jr. et al. ..... 128/870
5,044,031 A * 9/1991 Sherwood et al. ..... 2/69.5
5,046,204 A * 9/1991 Mohler ..... 5/413 R
5,058,226 A * 10/1991 Crosby ..... 5/494
5,121,514 A * 6/1992 Rosane ..... 5/628
5,129,406 A * 7/1992 Magnusen et al. ..... 128/873
5,189,746 A * 3/1993 Horie ..... 5/627
5,238,293 A * 8/1993 Gibson ..... 297/229
5,243,724 A * 9/1993 Barnes ..... 5/482
5,283,909 A * 2/1994 Hill ..... 2/69
5,678,888 A * 10/1997 Sowell et al. ..... 297/256.17
5,699,568 A * 12/1997 Couldridge ..... 5/628
5,781,946 A * 7/1998 McEntire et al. ..... 5/482
5,852,827 A * 12/1998 Lear ..... 2/69.5
5,970,542 A * 10/1999 Mays ..... 5/485

(Continued)

*Primary Examiner*—Robert G Santos
(74) *Attorney, Agent, or Firm*—Reed Smith LLP; Stanley P. Fisher, Esq.; Juan Carlos A. Marquez, Esq.

(57) ABSTRACT

An infant/toddler carrying apparatus that incorporates a center panel having at least two leg holes through which legs of an infant/toddler to be carried are inserted; and left and right wrapping panels fixedly connected to left and right edge portions of the center panel, at least the left and right wrapping panels being formed so as to wrappingly surround an infant/toddler to be carried. A panel insert is fixedly positioned with the center panel so as to reinforce or otherwise support the center panel. The center panel may include a fabric frame fixedly positioned on the center panel, and formed as at least one of a pocket, a warning label, an information insert, and an attachment loop. Also, the center panel may include a drop-in pocket in which the infant/toddler is positioned. The leg holes are positioned to allow the child's legs to extend therethrough.

11 Claims, 3 Drawing Sheets

U.S. PATENT DOCUMENTS 6,129,417 A * 10/2000 Cohen-Fyffe ..... 297/219.12
6,341,397 B1 * 1/2002 Kliegl et al. ..... 5/482
6,408,439 B1 * 6/2002 Garforth-Crippen ..... 2/80
6,428,098 B1 * 8/2002 Allbaugh ..... 297/219.12
6,643,870 B2 * 11/2003 Bertrand ..... 5/482
6,702,381 B2 * 3/2004 Endicott et al. ..... 297/256.17
6,757,922 B2 * 7/2004 Chancey ..... 5/482
6,817,033 B2 * 11/2004 Bailey ..... 2/69.5
6,848,743 B1 * 2/2005 Collins ..... 297/256.17
6,851,750 B2 * 2/2005 Sampson et al. ..... 297/256.17
6,868,566 B2 * 3/2005 Gatten ..... 5/494
6,948,200 B2 * 9/2005 Wyman ..... 5/494
6,948,725 B2 * 9/2005 Sampson et al. ..... 280/33.993
7,043,783 B2 * 5/2006 Gatten ..... 5/494
7,065,810 B2 * 6/2006 Robinson ..... 5/494
D527,562 S * 9/2006 Manning ..... D6/603
7,181,789 B2 * 2/2007 Gatten ..... 5/494
7,254,849 B1 * 8/2007 Fiebrich et al. ..... 5/482
7,287,676 B2 * 10/2007 Chua ..... 224/160
7,367,621 B1 * 5/2008 Han-Dressor et al. .. 297/256.17
2003/0227202 A1 * 12/2003 Endicott et al. ..... 297/256.17
2006/0150330 A1 * 7/2006 Gatten ..... 5/494
2008/0120774 A1 * 5/2008 Hite ..... 5/494

* cited by examiner

INFANT/TODDLER CARRYING APPARATUS

BACKGROUND OF THE INVENTION

1. Field of the Invention

The present invention is directed to an apparatus for wrapping an infant or toddler so as to facilitate the carrying of the infant or toddler by an adult.

2. The Prior Art

Currently, there exist many different types of carrying baskets, infant-carrying packs and carrying frames in the market. Though such products are useful and convenient for some parents in carrying their infant or toddler, such devices can be disadvantageous in that carrying baskets and carrying frames (i.e., child-carriers resembling baskets mounted on a backpacking frame) can be bulky to carry or store, while infant-carrying packs often use complex systems of straps and snap buckles to mount the child on the back or chest of an adult. Also, while such apparatuses are designed to carry infants or toddlers and to prevent their falling out, children are not snugly held in these prior art apparatuses. With carrying frames or infant-carrying packs, all the limbs of the children typically hang out of the apparatus. In the case of a carrying frame, the child is often held around the crotch area, but otherwise free to move back and forth and side-to-side in the frame.

Therefore, there exists a problem in that the child in a prior art carrying apparatus is not snugly held. For children in the infant stages especially, a child in a prior art carrying apparatus may not experience the full benefit of being closely held by its parent, such as when the child is held in its parent's arms. For the parent, if the child is in carrying basket, he/she must take the child out of the basket in order to closely hold the child. If the child is in either the carrying frame or the infant-carrying pack, and being carried on the parent's back, here also the parent must remove the child form the apparatus in order to hold the child close.

Consequently, there exists a need in the industry for an infant/toddler carrying apparatus wherein the problem of the prior art devices as described above can be avoided.

SUMMARY OF THE INVENTION

The present invention is directed to addressing the problem of the prior art apparatuses by providing an apparatus that can prevent the occurrence of such problems. Specifically, the present invention is based on a wrapping and tying system that incorporates features that improve on the concept of wrapping infants/toddlers. This concept of carrying a child, using a single piece of fabric and incorporating only wrapping and tying techniques is a timeless art. This is an art that has been around for thousands of years and used by women of many cultures all over the world. This age old concept is again slowly making its way into the lifestyles of our modern day parents and caregivers, and as more people are opening their minds to old ideas and concepts.

Specifically, the present invention in at least one embodiment is directed to a preemie/infant/toddler carrying apparatus equipped so as to accommodate it being used by most adults. The apparatus is designed to use various wrapping techniques to achieve more than nine (9) different child carrying styles, including but not limited to the hip carry, the forward facing front carry, the backward facing front carry, and several back carrying positions. The type of wrapping variation depends on the wearer's personal preference and child size. Wide panels of fabric allow for proper child weight distribution across the wearer's back, hips and shoulders virtually eliminating pressure points and discomfort. The holes in the fabric are intended for the child's legs to be inserted into thus creating a safe seat and freely adjusting shallow pocket for the child to sit. This safety seat eliminates the possibility of the child slipping out of the fabric during this wrapping process. The leg holes also allow for more wrapping variations giving the wearer freedom and peace of mind while improvising with their own personal wrapping techniques. The leg holes combined with selected wrapping techniques can also accommodate small/medium twins at the same time.

BRIEF DESCRIPTION OF THE DRAWINGS

The present invention will be described herein below in conjunction with the accompanying drawings illustrating the invention, wherein.

DETAILED DESCRIPTION OF THE PREFERRED EMBODIMENTS

Figure 1:
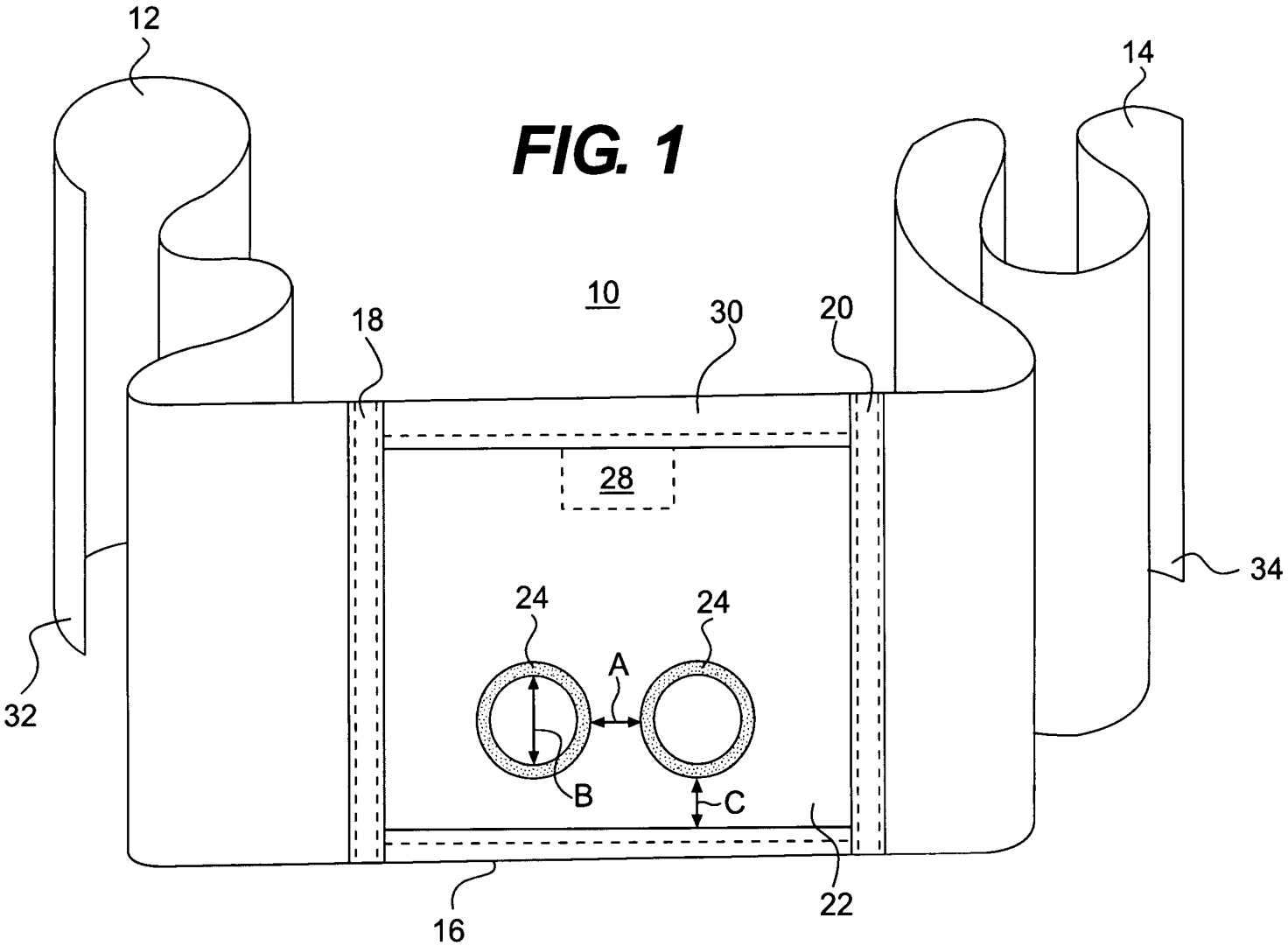
FIG. 1 illustrates a first embodiment of the present invention.

With reference to the figures, like reference characters will be used to indicate like elements throughout the several embodiments and views thereof. In particular, with reference to FIG. 1, present invention is directed to an infant/toddler carrying apparatus 10 comprising left and right wrapping panels 12,14 and a center panel 16. The left and right panels 12,14 are connected to the center panel 16 at left and right reinforced edge portions 18,20 thereof, respectively. A panel insert 22 is fixedly positioned with the center panel 16 in order to provide sturdy reinforcement or padding for the center panel 16. Leg holes 24 are defined through the center panel 16 and the panel insert 22 so as to accommodate the child's legs while the child is the apparatus 10.

In at least this first embodiment, the apparatus 10 made entirely of natural fiber materials, including but not limited to a 216" (6 yards)×24" piece of (hemmed or surged lengthwise) fabric that can be made from any of but not limited to cotton, interlock cotton, knit cotton, knit cotton blends, woven cotton, organic cotton, cotton/poly blends, hemp cotton and brocade fabrics (e.g., Asian fabrics, silks). For purposes of the apparatus 10, hemp cotton may be one preferred material as it has characteristics that make it superior to ordinary than cotton, including being soft, comfortable, moisture wicking, mold and mildew resistant, 55× stronger than cotton alone, blocks 95% of UV rays, cool in the summer, warm in the winter, a natural bug repellant. Cotton Muslins—soft, strong, simple fabrics and cotton gauze fabrics. The fabric is used to form the center panel 16 and the left and right panels 12,14. Alternatively, each of the different components for the apparatus 10 may be formed from different materials to serve different purposes. The center panel 16 may be formed from any of the above-listed fabrics, or formed from a water-repellant material (i.e., padded rubber, woven polyester, microfibre, Thinsulate®, Gortex®) so that it may be used as a changing pad for infants. The left and right wrapping panels 12,14 may be formed from a stretchable material (i.e., cotton blends, cotton muslins, Spandex®, Lycra®) in order to create a more form-fitting wrapping around the child. Materials such as Spandex® or swimwear material may also be used to make the left and right wrapping panels 12,14 so that the apparatus 10 can be used around the pool, at the beach, or just to shed water and dry quickly if wet.

In addition, other fabric materials may be used so as to serve specific purposes, including adding insulation (e.g., quilted or down padding, wool), or being water-repellant (e.g., Thinsulate®, Gortex®, or being UV proof, or minimizing the weight of the apparatus 10, while maximizing the sturdy or weight carrying capacity of the apparatus. Other alternative materials for the apparatus 10 or components thereof include lightweight canvas, linen blends, fleece, micro-fibre, micro-suede, cotton sateen and corduroy.

The left and right reinforced edge portions 18,20 are formed using fabric binding tape (i.e., fabric tape made from reinforced cotton fabric) that is held in place with reinforced stitching. The leg holes 24 are 4" (B) in diameter and positioned 4" (C) from the bottom hem 26, and centered approximately 5" (A) apart from each other. The outer ends 32,34 of the left and right panels 12,14, respectively, are reinforced with stitching 2" from the ends to prevent fraying and can incorporate decorative fringes.

The center panel 16 may also include a 3"×4" fabric frame 28 stitched to the center of the center panel 16 approximately 2" down from the top hem 30. This is for the purpose of marking the middle and the anterior sides of the apparatus 10. Variations for how this frame 28 is structured include forming the frame as a pocket, a warning label, an information insert, a loop for attaching the strap of various items (e.g., a strap attached to a pacifier or a toy).

The panel insert 22 may be built-in (i.e., sewn, glued) with the center panel 16 or maybe designed to be removable to accommodate the needs and desires of the wearer. For example, the panel insert may be formed from a quilted or other padded (i.e., containing down filling, polyester fibers, cotton fibers) fabric material to provide a softer section of the apparatus 10 to surround the child. The panel insert 22 may also be formed of a water-repellant material so that it may be used as a changing pad for infants by itself or in conjunction with the center panel 16. Alternatively, in the case of an older/larger child or when the apparatus 10 has to be worn for an extended period and to prevent sagging, the panel insert 22 may be used to provide reinforcement for the center panel 16 by being made of a soft, malleable but sturdy material (e.g., woven Kevlar® fibers) that can conform to the shape of the child being carried but still be comfortable, especially if padded.

The panel insert 22 may be connected or attached to the center panel 16 by any one of a number of known techniques for attaching two fabric covered elements together, including but not limited to the use of buttons/button holes, zippers, hook-and-loop fasteners, or a secondary pocket in the center panel 16.

In the application of the apparatus 10 of the present invention, the apparatus 10 may be used to wrap a child, in order to achieve at least eleven (11) different wrapping or child carrying styles, including but not limited to the hip carry, the forward facing front carry, the backward facing front carry, the shoulder carry, the front cross wrap, the cradle hold, the Tibetan, the rucksack, the back-cross wrap, the back cross wrap-with chest belt, the strap carry, the torso carry, and all variations thereof.

Among the features of the design of at least the first embodiment, the 24" width of the left, right and center panels allows for proper child weight distribution across the wearer's back, hips and shoulders virtually eliminating pressure points and discomfort. The leg holes 24 are intended for the child's legs to be inserted into thus creating a safe seat and freely adjusting shallow pocket for the child to sit when wrapped. This safety seat eliminates the possibility of the child slipping out of the apparatus 10 during the wrapping process. The leg holes 24 also allow for more wrapping variations giving the wearer freedom and peace of mind while improvising with his/her own personal wrapping techniques.

Among the features of the apparatus 10, the leg holes 24 being incorporated in the center panel 16 allows the wearer to avoid having to undo the wrapping in order to place the child in a car seat, stroller or other position. The wearer can simply remove the apparatus 10 from the carrying position on their body and use the apparatus 10 as a blanket. The wearer could even tie the left and right wrapping panels 12,14 to a chair securing the child in a makeshift "high chair" or "booster seat". In addition, the structure of the apparatus 10 makes it adaptable to other related uses. For example, Applicant has found that, in addition to being usable as a changing pad when untied and laid out flat (as described hereinabove), the apparatus when not in use can double as a cover or shade on a stroller or car seat. Further, the overlapping positioning of the left and right wrapping panels 12,14 inherently allow the wearer to carry or tuck any number or types of items in between the layers of the left and right wrapping panels wrapped around the child, including but not limited to bottles, diapers, wipes, toys and keys.

Figure 2:
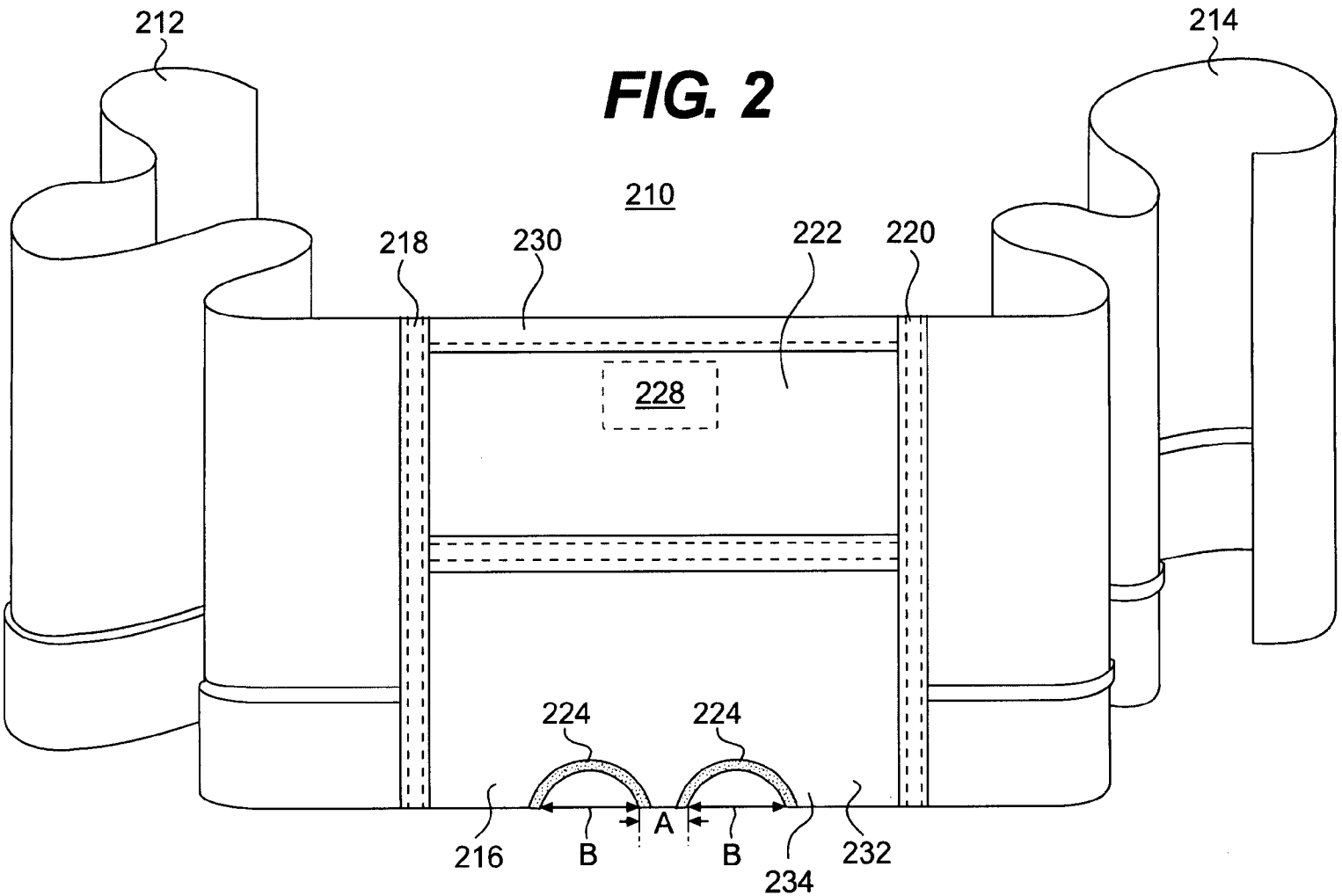
FIG. 2 illustrates a second embodiment of the present invention.

In a second embodiment of the present invention, as illustrated in FIG. 2, the infant/toddler carrying apparatus 210 comprising left and right wrapping panels 212,214 and a center panel 216. The left and right panels 212,214 are connected to the center panel 216 at left and right reinforced edge portions 218,220 thereof, respectively. A panel insert 222 is fixedly positioned with the center panel 216 in order to provide sturdy reinforcement for the center panel 16. In this second embodiment, the center panel 216 and panel insert 222 are formed to include a drop-in pocket 232 into which the child is positioned. The leg holes 224 are defined through the center panel 16 and the panel insert 22 along the lower edge 234 so as to accommodate the child's legs while the child is the drop-in pocket 232.

As with the first embodiment, in this second embodiment, fabric is used to form the center panel 216 and the left and right panels 212,214, with the left and right reinforced edge portions 218,220 being formed using binding tape held in place with reinforced stitching. The leg holes 224 are 4" (B) in diameter and centered approximately 5" (A) apart from each other. The outer ends 232,234 of the left and right panels 212,214, respectively, are also reinforced with stitching 2" from the ends to prevent fraying.

The center panel 216 may again include a 3"×4" fabric frame 228 stitched to the center of the center panel 16 approximately 2" down from the top hem 230 that is also structured as any one of a pocket, a warning label, an information insert, a loop for attaching the strap of various items.

Figure 3:
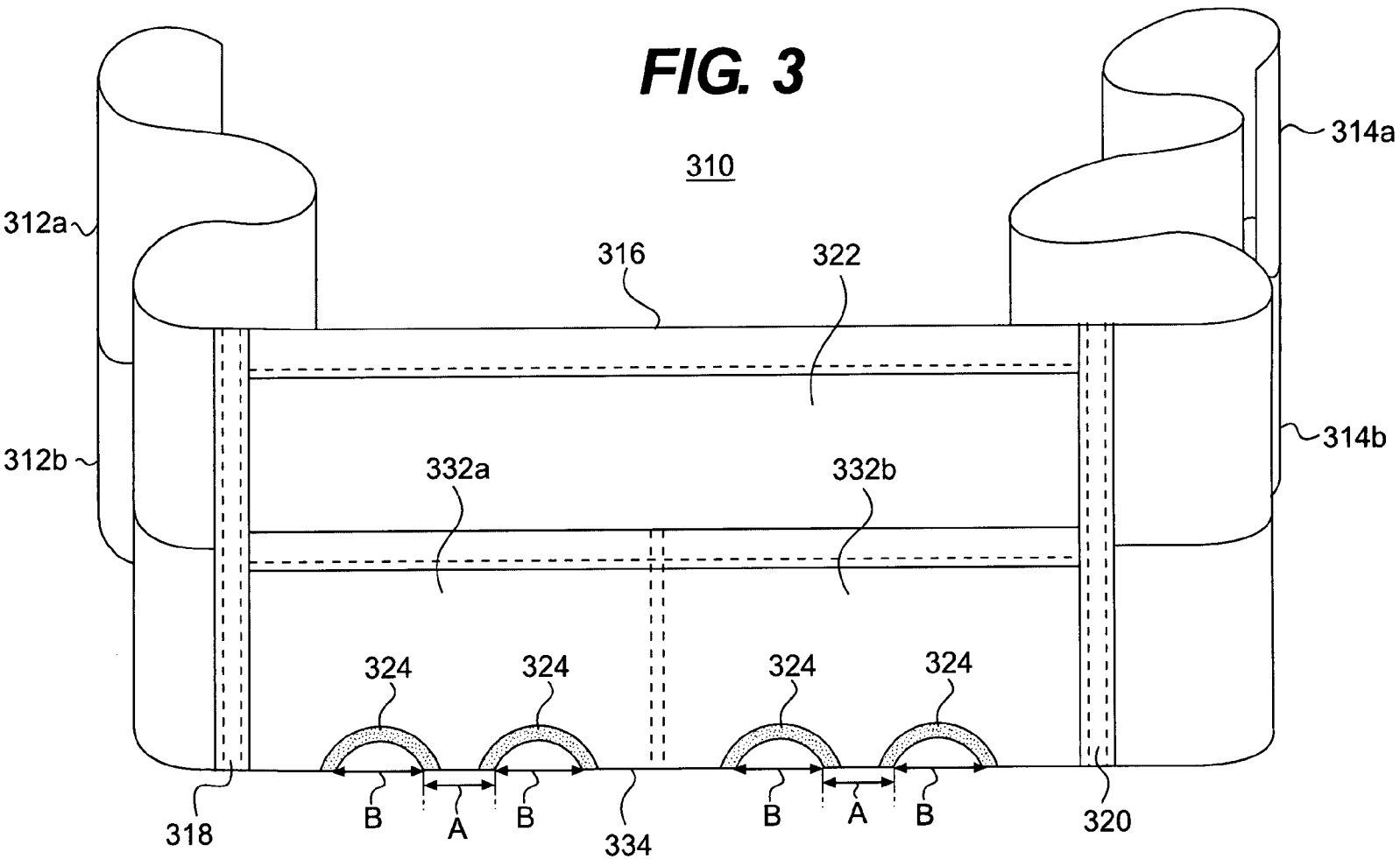
FIG. 3 illustrates a third embodiment of the present invention.

In a third embodiment of the present invention, as illustrated in FIG. 3, the infant/toddler carrying apparatus 310 comprising upper and lower left wrapping panels 312*a*,312*b*, upper and lower right wrapping panels 314*a*,314*b*, and a center panel 316. The left and right panels 312*a*,312*b*,314*a*, 314*b* are connected to the center panel 316 at left and right reinforced edge portions 318,320 thereof, respectively. A panel insert 322 is fixedly positioned with the center panel 316 in order to provide sturdy reinforcement for the center panel 316. In this third embodiment, the center panel 316 and panel insert 322 are formed to include two drop-in pockets 332*a*,332*b* into which two children are positioned. The leg holes 324 are defined through the center panel 316 and the panel insert 322 along the lower edge 334 so as to accommodate the children's legs while they are in the drop-in pockets 332*a*,332*b*.

As with the first embodiment, in this second embodiment, fabric is used to form the center panel 316 and the left and right panels 312*a*,312*b*,314*a*,314*b*, with the left and right reinforced edge portions 318,320 being formed using binding tape held in place with reinforced stitching. The leg holes 324 are all 4" (B) in diameter and each pair of leg holes for each pocket 332*a*,332*b* are centered approximately 5" (A) apart from each other. The outer ends 332,334 of the left and right panels 312*a*,312*b*,314*a*,314*b*, respectively, are also reinforced with stitching 3" from the ends to prevent fraying.

With this third embodiment, the adjacent drop-in pockets 332*a*,332*b* along with their corresponding leg holes 324 are intended to create safe seats and freely adjusting shallow pockets for the children to sit when wrapped. When fully wrapped, two children may be carried safely and snugly while still allowing the wearer freedom and peace of mind while improvising with his/her own personal wrapping techniques.

Among the features of the present invention, the structure and design of the apparatus 10 allows the wearer great versatility in using different wrapping styles in order to achieve any one of several carrying techniques. In addition, because the apparatus is made primarily from fabric, and does not incorporate any rigid frame or structure, using more than one apparatus or using the apparatus to carry more than one child without prohibitively great discomfort becomes possible. For example, Applicant has found that one apparatus can be used to wrap two small infants at the same time, or two separate apparatuses each carrying one infant can be worn at the same time.

Although the present invention has been fully described in connection with the preferred embodiments thereof with reference to the accompanying drawings, it is to be noted that various changes and modifications will be apparent to those skilled in the art. For example, the length, width or height of the individual panels or of the entire apparatus itself may be increased or decreased to accommodate the size of the child or children to be carried, or even to accommodate the height and size of the adult wearing the apparatus. Other elements may be incorporated into the center panel or panel insert so as to provide more support or comfort for the child to be carried (e.g., headrest pad, quilted padding). Even more, the outer ends of the left and right wrapping panels may include fastening elements to help in securing the wrapping (e.g., Velcro® hook-and-loop fasteners, adhesive pads, buttons) Such changes and modifications are to be understood as included within the scope of the present invention as defined by the appended claims, unless they depart therefrom.

I claim:

1. An infant/toddler carrying apparatus, comprising:

a center panel having defined therethrough at least two leg holes through which legs of an infant/toddler to be carried are inserted; and left and right wrapping panels fixedly connected to left and right reinforced edge portions of the center panel, at least the left and right wrapping panels being formed so as to wrappingly surround an infant/toddler to be carried and to snugly secure the infant/toddler to a wearer, wherein each of the left and right wrapping panels has a length longer than a length of the center panel in order to achieve different wrapping or child carrying styles, and wherein the left and right wrapping panels and the center panel have an identical average width and so connected to provide the apparatus in a rectangular shape and to allow for proper child weight distribution across a wearer's back, hips and shoulders virtually eliminating pressure points and discomfort.

2. An infant/toddler carrying apparatus according to claim 1, further comprising:

a panel insert fixedly positioned with the center panel so as to support the center panel.

3. An infant/toddler carrying apparatus according to claim 1, wherein the center panel includes a fabric frame fixedly positioned on the center panel, the fabric frame being formed as at least one of a pocket, a warning label, an information insert, and an attachment loop.

4. An infant/toddler carrying apparatus according to claim 1, wherein the center panel includes a drop-in pocket into which the infant/toddler to be carried is positioned, the leg holes being positionally defined in the drop-in pocket so as to allow the legs of the child to extend therethrough while the child is positioned in the drop-in pocket.

5. The infant/toddler carrying apparatus according to claim 1, wherein each of the center panel, the left and right wrapping panels are shaped in rectangular.

6. The infant/toddler carrying apparatus according to claim 1, wherein the apparatus is made entirely of fabric.

7. The infant/toddler carrying apparatus according to claim 1, wherein the left and right wrapping panels are made of a stretchable material.

8. An infant/toddler carrying apparatus, comprising:

a center panel that includes first and second drop-in pockets positioned adjacent to each other into which at least one infant/toddler to be carried is positioned, each of the first and second drop-in pockets having leg holes being positionally defined therethrough so as to allow legs of the at least one child to extend therethrough while the child is positioned in one of the first and second drop-in pockets; and left and right wrapping panels fixedly connected to left and right reinforced edge portions of the center panel, each of the left and right wrapping panels having an upper and lower portion, and the upper and lower left wrapping panels and the upper and lower right wrapping panels being formed so as to wrappingly surround the at least one infant/toddler to be carried and to snugly secure the infant/toddler to a wearer, wherein each of the left and right wrapping panels has a length longer than a length of the center panel in order to achieve different wrapping or child carrying styles, and wherein the left and right wrapping panels and the center panel have an identical average width and so connected to provide the apparatus in a rectangular shape and to allow for proper child weight distribution across a wearer's back, and shoulders virtually eliminating pressure points and discomfort.

9. The infant/toddler carrying apparatus according to claim 8, wherein each of the center panel, the left and right wrapping panels are shaped in rectangular.

10. The infant/toddler carrying apparatus according to claim 8, wherein the apparatus is made entirely of fabric.

11. The infant/toddler carrying apparatus according to claim 8, wherein the left and right wrapping panels are made of a stretchable material.

* * * * *